US011253773B2

(12) United States Patent
Doig et al.

(10) Patent No.: US 11,253,773 B2
(45) Date of Patent: Feb. 22, 2022

(54) SPORTS FIELD COVER SYSTEM

(71) Applicants: ALL WEATHER SPORTSCOVER LIMITED, Hamilton (NZ); Marcus Doig, Hamilton (NZ)

(72) Inventors: Marcus Doig, Hamilton (NZ); David Neil Lovegrove, Hamilton (NZ); Oliver Jackson-Hill, Hamilton (NZ); Darryl Best, Hamilton (NZ)

(73) Assignees: ALL WEATHER SPORTSCOVER LIMITED, Hamilton (NZ); Marcus Doig, Hamilton (NZ)

( * ) Notice: Subject to any disclaimer, the term of this patent is extended or adjusted under 35 U.S.C. 154(b) by 0 days.

(21) Appl. No.: 16/636,345

(22) PCT Filed: Jul. 31, 2018

(86) PCT No.: PCT/NZ2018/050106
§ 371 (c)(1),
(2) Date: Feb. 4, 2020

(87) PCT Pub. No.: WO2019/027333
PCT Pub. Date: Feb. 7, 2019

(65) Prior Publication Data

US 2020/0164265 A1 May 28, 2020

(30) Foreign Application Priority Data

Aug. 4, 2017 (NZ) ..... 734346
Dec. 14, 2017 (NZ) ..... 738357

(51) Int. Cl.
*A63C 19/12* (2006.01)

(52) U.S. Cl.
CPC ..... *A63C 19/12* (2013.01)

(58) Field of Classification Search
CPC ..... A63C 19/12
(Continued)

(56) References Cited

U.S. PATENT DOCUMENTS 3,005,461 A * 10/1961 Arganbright ..... A63C 19/12 473/504
3,108,804 A * 10/1963 Wagner ..... A63C 19/12 473/504
7,195,572 B1 * 3/2007 Swain ..... A63C 19/12 473/504

FOREIGN PATENT DOCUMENTS

DE 7313037 U 8/1973
DE 3130858 A1 5/1983
(Continued)

*Primary Examiner* — Mitra Aryanpour
(74) *Attorney, Agent, or Firm* — Pilloff Passino & Cosenza LLP; Sean A. Passino; Rachel K. Pilloff

(57) ABSTRACT

A field cover system to selectively cover, and uncover, a sports field or similar is described. The field cover system comprising a flexible resilient planar material to extend and cover the sports field, and to retract and uncover the sports field, a plurality of elongate support members, moveable to extend between a retracted position and an extended position, and one or more tensile members configured to, in use, support and/or attach to the cover and attach to the plurality of elongate support members. In the retracted position the plurality of elongate support members is located substantially below a surface level of the sports field, and in the extended position and with the tensile members attached to or supporting the cover, the elongate support members elevate the flexible resilient planar material above the sports field.

22 Claims, 10 Drawing Sheets

(58) Field of Classification Search
USPC ..... 473/504
See application file for complete search history.

(56) References Cited

FOREIGN PATENT DOCUMENTS

| | | | | |
|---|---|---|---|---|
| DE | 8406994 | U1 | 6/1984 | |
| FR | 2699829 | A1 | 7/1994 | |
| FR | 2700184 | A1 | 7/1994 | |
| FR | 2742348 | A1 | 12/1995 | |
| KR | 101332636 | B1 | 11/2013 | |
| RU | 2016605 | C1 | 7/1994 | |
| WO | 2012/150912 | A2 | 11/2012 | |
| WO | WO-2019027333 | A1 * | 2/2019 | ..... A63C 19/12 |

* cited by examiner

SPORTS FIELD COVER SYSTEM

TECHNICAL FIELD OF THE INVENTION

The present invention relates to protecting covers for sports grounds or similar. In particular, but not exclusively, the present invention is directed to field covers which can be used to protect the grass, or other surface, of sports fields, or large ground areas that require a cover. More particularly, the invention relates to a semi-automated deployment and retaining method for a field cover for sports fields of stadiums and the like. The present invention may also be applied in other professions and surfaces where covers are required.

BACKGROUND OF THE INVENTION

It has long been appreciated that it is desirable to have means whereby grounds, for example sport fields, in particular but not exclusively grass fields, can be protected from the elements, such as detrimental effects of excessive rainfall, which may cause damages in order to limit the periods during which the grass surface is in a condition that prevents its use.

It is also desirable from a consistency of play and player safety that a field has little or no standing water.

One solution from the prior art is to enclose the entire stadium, with a fixed, or retractable roof. However, the cost to implement such a roof is expensive and requires difficult regular maintenance.

Another solution is to cover the sports surface with a conventional cover or tarpaulin that is dragged out onto the field, for example as used to cover a cricket wicket. This only covers a small area and is slow and cumbersome to deploy and put away. Protecting an entire field, for example a rugby field is not efficient or feasible.

Such protective means are known to be expensive and difficult to manoeuvre into position, due to their large size and weight. As a result, maintenance and use of the protective means tend to be costly, time consuming and require many operators. It is therefore advantageous for any protective means, such as a cover, to be put into place over the surface requiring protection, and removal afterwards, in a damage-limiting, fast and efficient manner, with a limited number of operators and be easily stored in a compact manner when not in use.

Further, conventional protective covers are known to protect the grass surface from close range (i.e. sitting on the grass surface), preventing air circulation and therefore provide a short-term solution only. Such a system is provided by Applied Technical Products Limited (UK) under the brand name Matchsaver™. A long term covering, for example when there is a long period of undesirable weather can kill the grass, or otherwise cause a sports surface to deteriorate. It is therefore advantageous for the protective cover to allow for air circulation to prevent "sweating" and/or frosting of the grass, while still not being susceptible to external forces, such as wind. A system comprising a raised cover is provided by Sports and Stadia Limited (UK). The Sports and Stadia system utilises an inflatable central tube or cylinder to hold the cover above the sports field. However, such a system can take a long time to deploy and retrieve, around 2-hours, due to the time it takes to inflate and deflate the cylinder, and requires many personnel.

Further such close range, or on surface coverings, do not allow for work or maintenance of the ground to be carried out. For example, a worker or equipment cannot move under such a cover, and requires exposure of the ground to be worked on and an additional covering with worker space.

Further after such work is carried out, a close covering will not allow regeneration of the sports surface, for example re-sown grass to germinate and grow.

OBJECTS OF THE INVENTION

It is an object of the invention to provide a field cover system and/or equipment thereof, or a method for covering a sports field, which at least goes some way toward overcoming the above disadvantages or which at least provides the public with a useful choice.

Further objects of the invention will become apparent from the following description.

BRIEF DESCRIPTION OF THE INVENTION

According to a first aspect of the present invention there is provided a field cover system to selectively cover, and uncover, a sports field or similar, the field cover system comprising:

- a flexible resilient planar material to extend and cover the sports field, and to retract and uncover the sports field;
- a plurality of elongate support members, moveable to extend between a retracted position and an extended position, in the extended position the plurality of elongate support members extending above the sports field; and
- one or more tensile members configured to, in use, support or attach to the cover and attach to the plurality of elongate support members, and
- wherein in the retracted position the plurality of elongate support members are located substantially below a surface level of the sports field, and in the extended position and with the tensile members attached to or supporting the cover, the elongate support members elevate the flexible resilient planar material above the sports field.

In some embodiments, the system comprises a plurality of hydraulic rams, each ram comprising a piston, a piston rod extending from the piston, and a cylinder,

- and wherein each elongate support member is a said piston rod, and
- wherein each cylinder is located substantially below the surface level of the sports field with a cylinder head at or adjacent the surface level of the sports field.

In some embodiments, the system comprises a plurality of chambers located substantially below the surface level of the sports field, the plurality of elongate support members received in the plurality of chambers when in the retracted position, and the elongate support members extending from the chambers to above the surface level of the sports field in the extended position.

In some embodiments, system comprises a plurality of actuators to drive the elongate support member between the retracted and extended positions.

In some embodiments, the system comprises a plurality of elongate support member assemblies, each assembly comprising a chamber located substantially below the surface level of the sports field, a said elongate support member slidingly received in the chamber, and an actuator to move the elongate support member between the retracted position received in the chamber substantially below ground level and the extended position to extend from the chamber to above the surface level of the sports field.

In some embodiments, the elongate support member telescopes into the chamber to move from the extended position to the retracted position.

In some embodiments, each elongate support member assembly comprises a seal between the chamber and the elongate support member to avoid or minimise debris passing into the chamber.

In some embodiments, the actuator is a ram.

In some embodiments, the ram comprises a piston and a cylinder and wherein the piston is provided to a bottom end of the elongate support member.

In some embodiments, the ram is a hydraulic ram.

In some embodiments, the ram is attached to a bottom of the chamber or wherein a cylinder head of the ram is attached to the bottom of the chamber or forms the bottom of the chamber.

In some embodiments, each elongate support member assembly comprises a power connection at or towards or adjacent a top end of the elongate support member assembly, and one or more service lines from the connection to the actuator.

In some embodiments, the system comprises a plurality of caps to cover the plurality of elongate support members when in the retracted position with the plurality of covers substantially flush with the surface of the sports field.

In some embodiments, the plurality of elongate support members are angled outwards with respect to a centreline of the supports field so that a said tensile member and/or the cover attached between a pair of said elongate support members is tensioned as the pair of elongate support members move from the retracted position to the extended position to support the cover above the sports field.

In some embodiments, the plurality of elongate support members are arranged in pairs, the elongate support members of each pair arranged on opposite sides of the sports field.

In some embodiments, in the extended position, a central pair of elongate support members extend higher than other pairs of elongate support members.

In some embodiments, the central pair of elongate support members is longer than one or more other pairs of elongate support members.

In some embodiments, the tensile members are guy lines or similar.

In some embodiments, the flexible planar material co-extends at least in part to a periphery of the sports field.

In some embodiments, the elongate support members are at or near the periphery of the sports field.

In some embodiments, the at least partly elevated flexible planar material has a convex arrangement from above along a first axis.

In some embodiments, the at least partly elevated flexible planar material has a concave arrangement from above along a second axis.

In some embodiments, the first axis is at an angle to the second axis, for example the first axis is perpendicular to the second axis.

In some embodiments, the plurality of support members, when not in use retract into a plurality of chambers or housings in the sports field.

In some embodiments, the plurality of support members extend and retract using a hydraulic mechanism.

In some embodiments, the plurality of support members telescope into the plurality of chambers or housings.

In some embodiments, the extension and retraction of the plurality of support members is remotely controlled, in a manual or automatic manner.

In some embodiments, there is at least one flexible tensile member to connect to each of the plurality of support members.

In some embodiments, each of the plurality of tensile members are stored within an underground storage chamber or cabinet which includes an openable cover at or near to ground level.

In some embodiments, each of the plurality of tensile members are provided on a reel.

In some embodiments, the reel is powered to tension the tensile member or cover or both.

In some embodiments, the plurality of support members comprise at least one connection point for receiving and being attached to at least one tensile member.

In some embodiments, the plurality of support members or tensile members further comprise a smart sensing system.

In some embodiments, the smart sensing system provides the ability to automatically adjust the plurality of support members in accordance to varying height and load parameters.

In some embodiments, the flexible resilient planar material is made from a reinforced plastic material.

In some embodiments, the cover system further comprises one or more fastening means, configured to secure the flexible planar members to the sports field.

In some embodiments, the fastening means are at one or more corner points and/or one or more edges of the periphery of the sports field.

In some embodiments, the extension of the support members tensions the tensile members and/or cover and lifts the flexible tensile member off the majority of the sports field.

In some embodiments, there is provided a storage cabinet for the flexible resilient planar material when not in use.

In some embodiments, the storage cabinet is below the surface level of the sports field.

In some embodiments, the storage cabinet includes a movable cover to selectively cover and expose the storage cabinet to allow extension and retraction of the cover.

In some embodiments, the storage cabinet includes a lift to lift the cover out of the cabinet when needed to cover the field, and to lower the cover into the cabinet when uncovering the field.

In some embodiments, the flexible resilient planar material is stored in a roll form, when not in use.

In some embodiments, there is a core or roller that supports the material when stored in roll form.

In some embodiments, the core travels across the sports field to unroll the stored material.

In some embodiments, the core is supported on a trolley at either end thereof.

In some embodiments, there is provided one or more support structures configured to be placed underneath the flexible resilient planar material.

In some embodiments, the one or more support structures comprise at least one adjustable support arm.

In some embodiments, the at least one adjustable support arm comprises an upper surface configured to abut an inner surface of the planar material.

In some embodiments, the one or more support structures are portable tripods.

In some embodiments, the one or more support structures have a load spreading component where they contact the flexible support member.

According to a second aspect of the present invention there is provided a method for covering a sports field, comprising:

deploying a cover material from a roll over a sports field, anchoring the cover material to the sports field at least in two or more opposing corners or ends of the cover material, connecting tensile members that attach to or support the cover material to a plurality of elongate support members at or towards a periphery of the cover material or sports field, with the elongate support members in a retracted position substantially below a surface level of the sports field, extending the plurality of elongate support members upwardly from the retracted position substantially below the level of the sports field to an extended position above the sports field, to tension the tensile members and/or the cover material and lift the cover material above the sports field.

In some embodiments, the method comprises:

laying the tensile members across the field and attaching each tensile member between a pair of said elongate support members, deploying the cover material from the roll over the sports field and over the tensile members, with the elongate support members in the retracted position substantially below a surface level of the sports field.

In some embodiments, the method comprises:

attaching the cover to the elongate support members with the elongate support members in the retracted position substantially below a surface level of the sports field.

In some embodiments, the method comprises:

providing the plurality of elongate support members angled outwards with respect to a centreline of the supports field, and extending the plurality of elongate support members so that said tensile members and/or the cover are/is tensioned as the elongate support members move from the retracted position to the extended position.

In some embodiments, the method comprises, extending a central pair of elongate support members higher than other pairs of elongate support members.

This invention may also be said broadly to consist in the parts, elements and features referred to or indicated in the specification of the application, individually or collectively, and any or all combinations of any two or more of said parts, elements and features, and where specific integers are mentioned herein which have known equivalents in the art to which this invention relates, such known equivalents are deemed to be incorporated herein as if individually set forth.

Other aspects of the invention may become apparent from the following description which is given by way of example only and with reference to the accompanying drawings.

BRIEF DESCRIPTION OF THE DRAWINGS

A number of embodiments of the present invention will now be described with reference to the accompanying drawings in which:

FIG. 25A shows the piston rod retracted, and FIG. 25B shows the piston rod extended.

FIG. 26A shows an elongate support member of the assembly in a retracted position, and FIG. 26B shows the elongate support member in an extended position.

DETAILED DESCRIPTION OF THE INVENTION

Preferred embodiments will now be described with reference to FIGS. 1 through 32.

In the following description, numerous specific details are set forth in order to provide a thorough understanding of the various principles of the present invention. However, those skilled in the art will appreciate that not all these details are necessarily always required for practising the present invention. The foregoing description of the invention includes preferred forms thereof. Modifications may be made thereto without departing from the scope of the invention.

Figure 1:
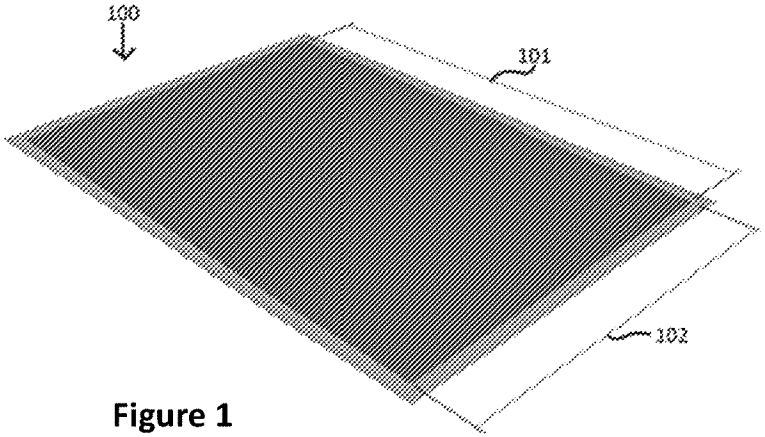
FIG. 1 shows a typical sports field, for which protection can be used.

FIG. 1 shows a typical sports field 100 with a length 101 and width 102, for which a protective field cover, may be used to protect the field in the event of unsuitable conditions such as excessive rainfall, heat, cold, wind or similar. While the illustrated sports field 100 is of a rectangular arrangement, those skilled in the art will appreciate that other field arrangements with varying sizes and dimensions are also possible from 3 to many sides approximating a circle, whether symmetrical or not. In some embodiments, the sports field comprises a length of 100 m and a width of 70 m, such as a typical soccer, cricket, or rugby field.

Figure 2:
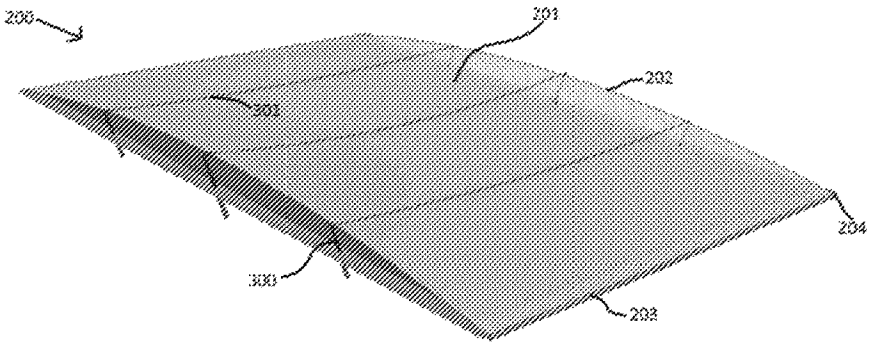
FIG. 2 is a schematic view of a semi-automated field cover, constructed and operative in accordance with an embodiment of the present invention.
Figure 3:
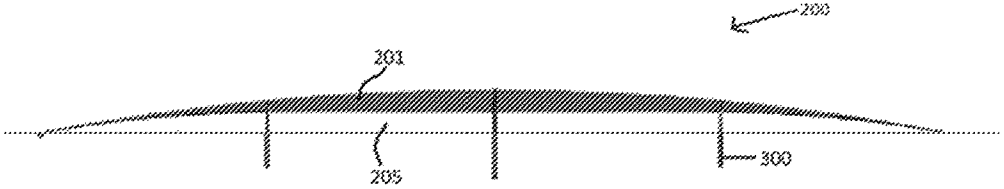
FIG. 3 is a side view of an embodiment of the semi-automatic field cover of FIG. 2 showing its convex shape.
Figure 4:
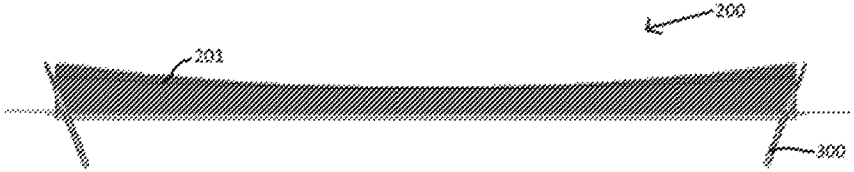
FIG. 4 is a front/rear view of the semi-automated field cover of FIGS. 2-3 showing its concave shape.
Figure 5:
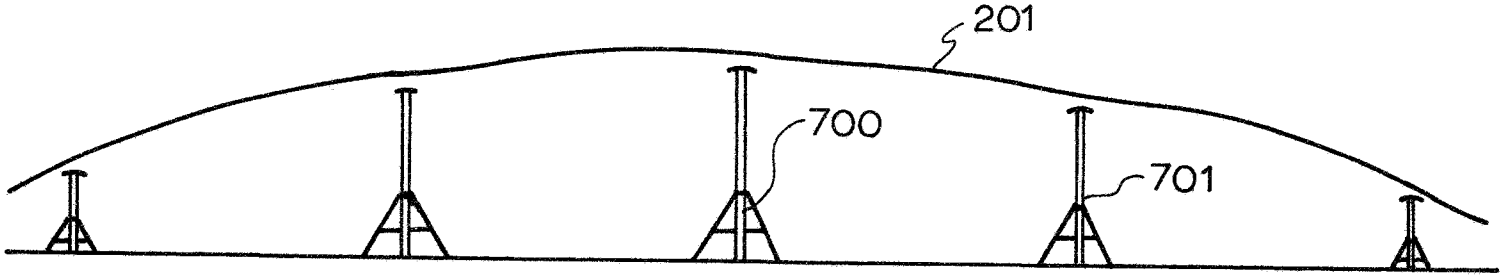
FIG. 5 is a side view of a semi-automatic field cover, constructed and operative in accordance with an embodiment of the present invention, showing the support structures.
Figure 6:
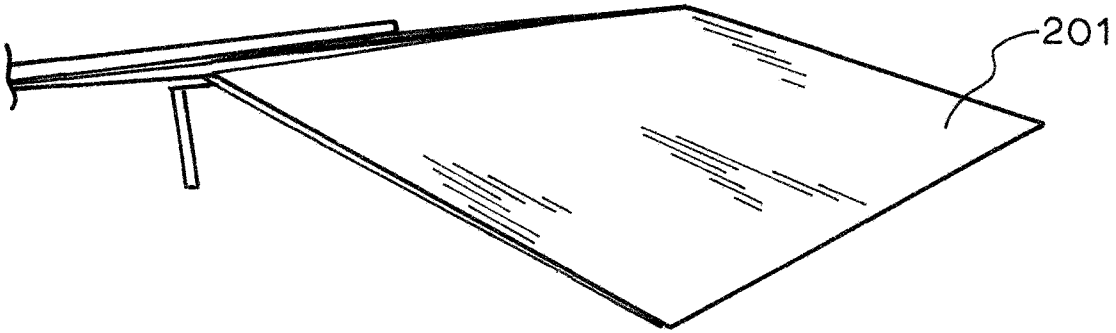
FIG. 6 is a schematic view of a semi-automated field cover, constructed and operative in accordance with an embodiment of the present invention.
Figure 9:
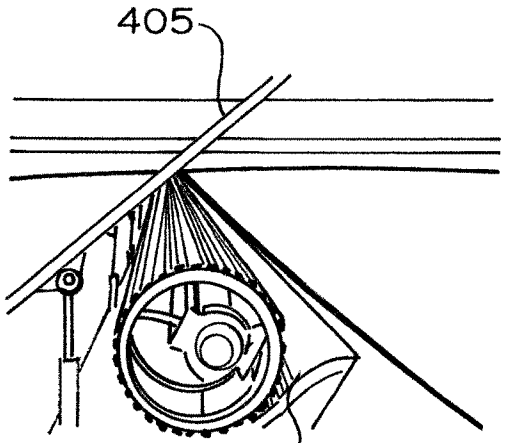
FIG. 9 is a side perspective view of the roll of FIGS. 7-8 being released.
Figure 10:
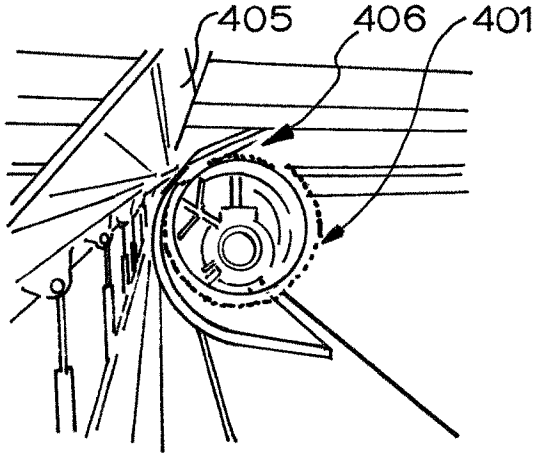
FIG. 10 is a side view of the roll of FIGS. 7-9 being released.
Figure 8:
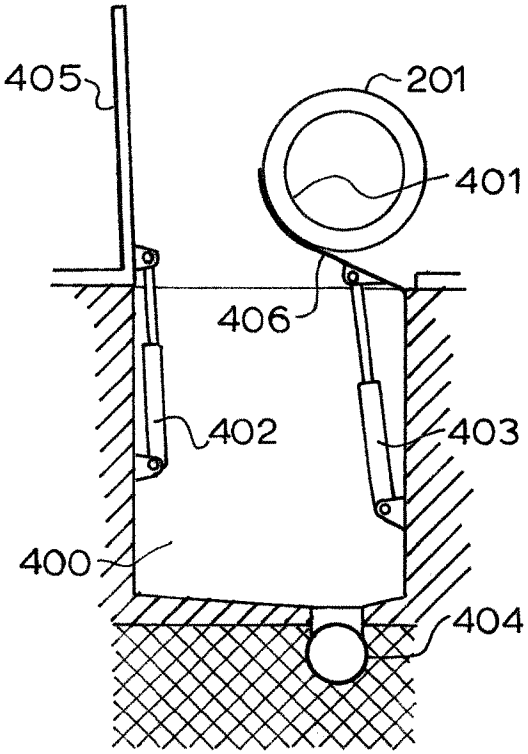
FIG. 8 is a sectioned view of the roller of FIG. 7 being released.
Figure 7:
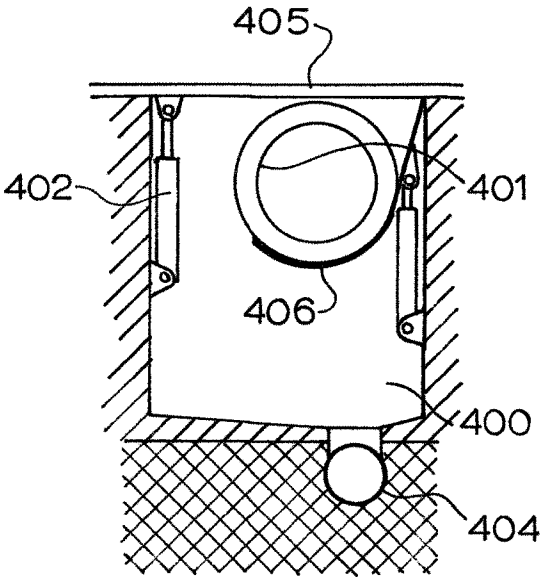
FIG. 7 is a sectioned view of an embodiment of the core containing the rolled up material in an embodiment of the stowage.

FIGS. 2 to 6 show an embodiment of the semi-automated field cover system 200 comprising a field cover 201 which can be used to protect a sports field 100. In some embodiments, the field cover 201 may be made up of flexible resilient planar material. For example, the cover material may be a polymer/plastic sheet material or reinforced plastic sheet material, or other material suitable for protecting or covering the field. Preferably the cover material is impervious to water. In some embodiments, there may be a semi-elevated field cover 201 that is convex (i.e. bulged) in length 202 (as shown in FIG. 3) and along a first axis, and concave (i.e. sagged) in width 203 (as shown in FIG. 4) and along a second axis when viewed from above. In some embodiments, the first axis is at an angle to the second axis. Alternatively, the semi-elevated field cover 201 may comprise a triangular cross section, i.e. the erected/elevated cover may have a ridge line, as shown in FIG. 6. One purpose of such arrangements is to avoid the build-up of rainwater on the field cover 201 and to provide efficient draining means, in order to avoid damages resulting from concentrated high loads on the field cover 201. The semi-automated field cover system 200 may comprise one or more drains at one or more positions on the sides 101, 102 of the sports field 100, towards which rainwater will be directed to by the field cover 201. Those skilled in the art would appreciate that other suitable arrangements of the field cover 201 and the drain(s) are possible.

In some embodiments, the dimensions of the field cover 201 is similar or identical to the sports field 100, allowing the field cover 201 to entirely cover the field 100. However, it is possible to use the field cover 201 to only cover parts of the field 100 if desired. The field cover 201 may comprise one or more anchoring corners 204 which may be fixed at, or near to, the ground to secure the position of the field cover 201. Possible embodiments and methods for securing the anchoring corners 204 of the field cover 201 are described in more detail below.

In the demonstrated embodiment of FIGS. 2 to 6, the semi-automated field cover system 200 comprises a plurality of elongate support members 300 provided at or near the periphery and on opposite sides (in pairs) of the sports field 100. The pair(s) of support members 300 may be connected together via a tensile member such as a guy line 301, which may be used to provide and sustain a desired structural arrangement of the field cover 201, such as described above and illustrated in the figures. In the illustrated embodiment the support members are angled outwards from the sports field, i.e. outward with respect to a centre or centreline of the field. For example, the support members may be angled outwards at an angle of 10 degrees to 45 degrees.

The tensile members may support the cover from below and may be separate to the cover, or may be attached to the cover. For example, the guy lines may be built into the cover, or may extend from an edge of the cover. The guy lines are preferably parallel to the roller axis.

A pair of elongate support members 300 located at or nearest to a centre line of the sports field may extend higher than support members located further from the centreline of the sports field, as shown in FIGS. 2 and 3. This presents a convex shape for an upper surface of the cover 201 when viewed from one side, i.e. in a length or first axis or direction, as described above and shown in FIG. 3. Due to a sag in each tensile member extending between a pair of support members 300 across the field, the upper surface of the cover presents a concave shape when viewed from a side or end of the field, i.e. in a width or second axis or direction perpendicular to the first axis or direction.

A central pair of elongate support members may be longer than one or more other pairs, or may be controlled to a higher extension than other pairs.

As shown in FIGS. 5 and 6, the semi-automated cover system 200 may comprise a semi-elevated field cover 201 and an embodiment of one or more portable support structures 700 which can be placed underneath the field cover 201 to provide support to maintain the structure of the field cover 201 and prevent sagging and/or collapsing of the semi-elevated field cover 201. The portable support structures may be mobile tripods, e.g. mobile scaffold tripods. The structures 700 may be deployed before or after the cover is deployed to cover the field. The portable support structures may be evenly or unevenly distributed underneath the semi-elevated field cover 201 to prevent sagging of the field cover 201. Those skilled in the art would appreciate that other embodiments of the one or more portable support structures are possible.

Possible embodiments and methods for installing the semi-automated field cover system 200 are now described in detail below.

Reference is now made to FIGS. 7 to 12 which show embodiments of a cabinet 400, which in the preferred form is at least in part, or wholly underground, within which a core or tubular member acting as a roller 401 that is configured to carry and deploy the field cover 201 is stowed. The roller may have a diameter of about 400 mm. The cover is wound or wrapped onto the roller for stowage, and is unwound from the roller to be deployed. The diameter of the roller plus cover wrapped onto the roller may be in the order of about 550 to 650 mm. In some embodiments, prior to the withdrawal of the roller 401 from the underground cabinet 400, it may be required for the guy lines 301 to be fed and/or placed in a position across or over the sports field while the roller 401 is in stowage or being withdrawn (i.e. lifted state). As a result, once the field cover 201 has been deployed by the roller across the field, the guy lines 301 will be positioned underneath the field cover 201.

In an alternative embodiment, the guy lines 301 may be attached to the field cover 201, such that when the field cover 301 is deployed by the roller 401, the guy lines 301 are placed underneath the field cover 201 or extend from edges of the cover. Guy lines may the attached to the cover after it has been deployed. For example, a guy line may be attached between a side edge of the cover and an elongate support member 300. Further, in order to commence the deployment of the roller 401 and therefore the field cover 201, it may be required for objects such as flags and goal posts to be removed from the sports field 100, to ensure that unobstructed deployment is carried out.

In some embodiments, an underground cabinet 400 may be provided at one end or both ends of the sports field 100 to accommodate the roller 401 bearing the field cover 201 at one end and the roller without the field cover at the other end after deploying the cover. The underground cabinet 400 may comprise retaining means 406 for holding the roller 401, and a cover 405 that is preferably flush with the (grass) surface of the field when closed. The cover may comprise a surface the same as or similar to the surface of the playing field. For example, the cover may comprise a surface made up of astro-turf. In such an arrangement, it is required for the cover 405 to be opened, manually or automatically, and the roller 401 to be withdrawn from the cavity of the cabinet, by lifting/raising the retaining means 406 out of the cavity of the underground cabinet 400.

As shown in the embodiment of FIGS. 7 to 10, the underground cabinet 400 may comprise a first prime mover or actuator 402, for example a directly or indirectly hydraulic, pneumatic, or thread driven ram or cylinder, that is configured to, when activated, open the cover 405 by applying an upward force. Further, the underground cabinet 400 may comprise a second prime mover or actuator 403, for example a directly or indirectly hydraulic, pneumatic, or thread driven ram configured to lift the retaining means 406, i.e. by pivoting about a pivot or hinge, and therefore lift the roller 401 out of the cavity of the underground cabinet 400. The retaining means or member 406 preferably forms or provides a cradle for the roller carrying the cover, i.e. with the cover wrapped onto the roller. In some embodiments the cradle 406 is continuous along substantially the full length of the roller.

Figure 11:
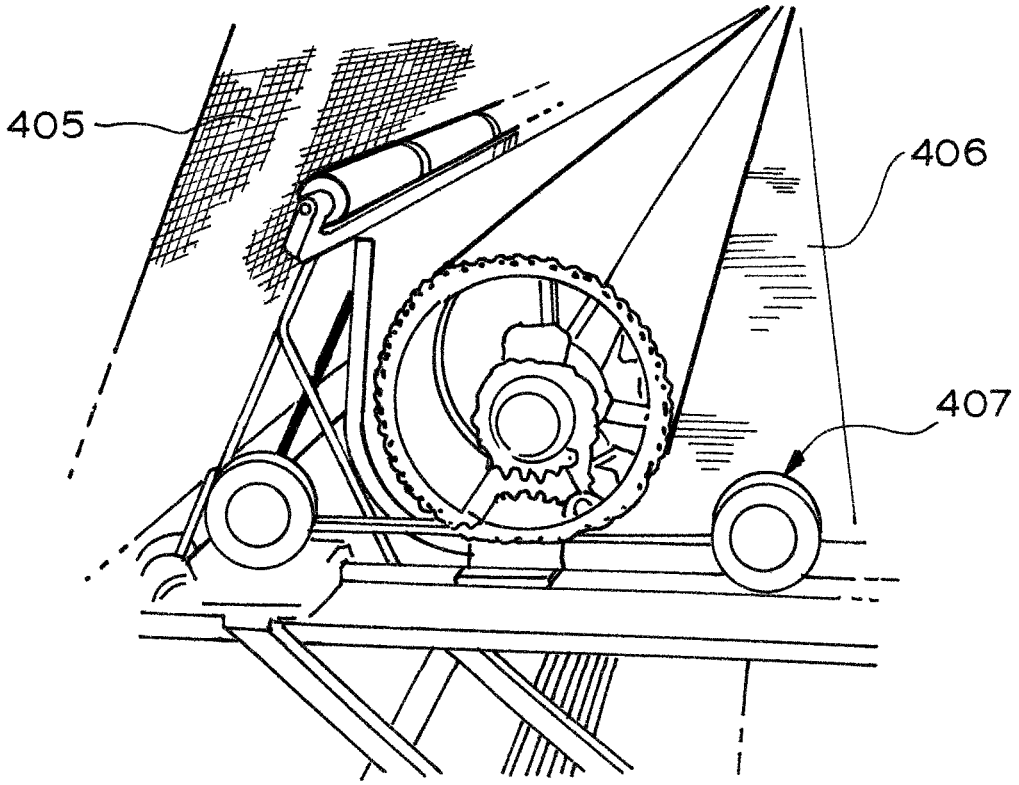
FIG. 11 is a side view of the release of an embodiment of the roll in an embodiment of the stowage where there is a support trolley at either end.
Figure 12:
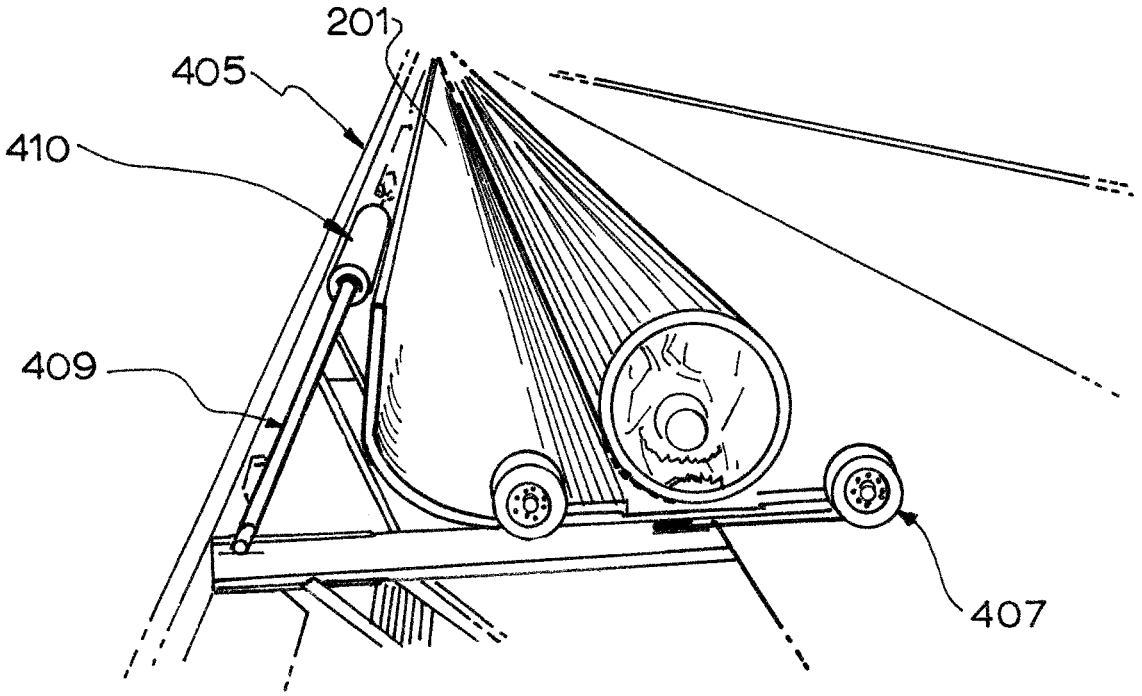
FIG. 12 is a side view of the roll of FIG. 11 being released and the trolley travelling out.

In an alternative embodiment, such as those shown in FIGS. 11 to 12, the actuator for lifting the retaining means 406 may comprise at least one mechanical lift device (e.g. a scissor type lift) that is configured to raise in a vertical direction and as a result, lift the roller 401 out of the cavity of the underground cabinet 400. In some embodiments, the at least one lift is electrically connected to an electrical circuit or may be hydraulically driven, and may be operated in an automatic and/or remote manner. Alternatively, the at least one lift can be manually operated by one or more operators. In some embodiments, the system may comprise a plurality of lifts (e.g. seven) that are uniformly or non-uniformly spaced from each other to lift the retaining means/cradle 406. In some embodiments, the plurality of lifts may be uniformly spaced from each other by 10 metres.

In some embodiments, the retaining means 406 or the lift or prime mover may comprise a member or frame 409 to engage the cavity cover 405 to open the cover when the retaining means is raised in an upward, vertical direction and close the cover 405 when lift is lowered in a downward, vertical direction. In some embodiments, the rubber rollers 410 may be provided to the member or frame 409 to contact an inner surface of the cover 405 and apply a force thereto, to open the cover. In such arrangements, the first prime mover 402 may not be required and/or used.

Those skilled in the art would appreciate that alternative suitable embodiments of the cabinet 400, above, below and partially below ground are possible. Following the withdrawal of the roller 401 from the underground cabinet 400, the deployment process can commence. When the cabinet 400 is mounted partially or fully above ground the cabinet cover 405 may be on a side to allow access, extension and retraction of the roller with cover 201 from the cabinet.

In some embodiments, the roller 401 may operate in an automated manner and may comprise or be provided with at least one motor and/or a gearbox to propel the roller along the field. As the roller is propelled across the field, the roller unwraps the cover from the roller to deploy the cover over the field.

In some embodiments, one or more of the roller 401 (e.g. its speed and direction), the first prime mover 402 and the second prime mover 403 may be remotely controllable, providing the possibility for a wireless control and monitoring system. This advantageously improves the efficiency and maintenance of the deployment process of the field cover 201 and reduces the number of tasks which are required to be done manually. Further, in the event of high wind loading in severe environmental conditions, the wireless control and monitoring system provides a convenient solution for controlling a collapse or taking down of the field cover 201 remotely, in order to protect the field cover 201 and the sports field 100 from expensive damage. In alternative embodiments, the roller 401 may be used manually by one or more operators.

Further, in some embodiments, the underground cabinet 400 may further comprise a drainage system 404 towards which, as mentioned above, collected rainwater from the field cover 201 will be directed to. In some embodiments, the cover 405 may be perforated, in order to allow for the rainwater to travel through the cover 405 and towards the drainage system 404. In an alternative embodiment, the cover 405 may simply be left open.

FIGS. 14 to 17B show the process of deploying the field cover 201 using the roller 401 after the roller has been lifted out of the cabinet. After withdrawing the roller 401 and the field cover 201 from the cabinet 400, in this case from an underground cabinet, and placing the guy lines 301 across the field, as described above, the roller 401 can be controlled to manoeuvre and deploy the field cover 201 across a desired area of the sports field 100.

Figure 13:
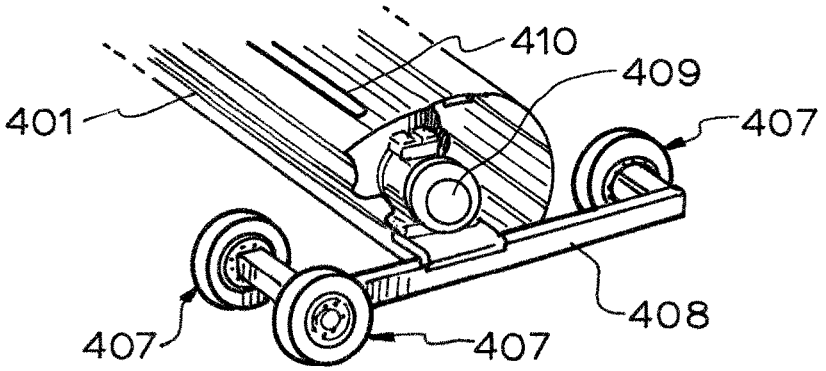
FIG. 13 shows a trolley attached to an end of the roller.
Figure 14:
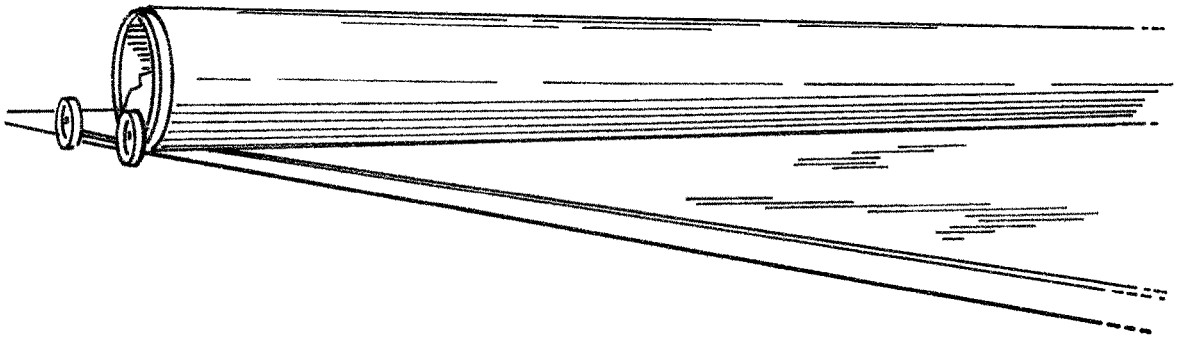
FIG. 14 is a side view of the roller deploying the field cover.
Figure 15:
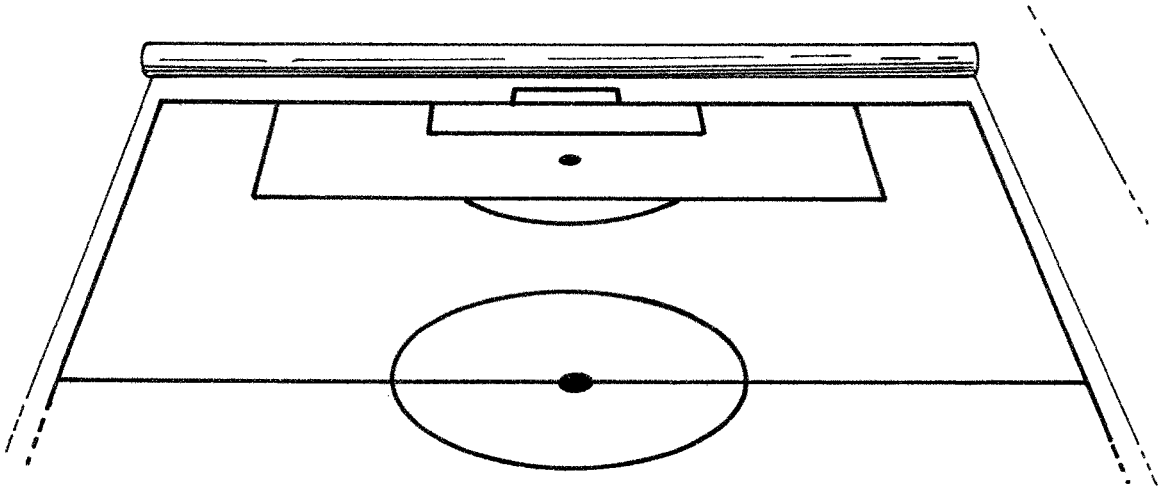
FIG. 15 is an elevated view of the roller deploying the field cover.

In some embodiments, the roller 401 may comprise a plurality of wheels 407 in order to improve the stability and accuracy of the movement of the roller 401. The wheels 407 may be separately attached to the roller 401, once it has been withdrawn from the underground cabinet 400. A motorised bogie or trolley/trundler 408 may be provided to each end of the roller 401, as shown in FIG. 13. A trundler may be attached to each end of the roller after it has been lifted out of the inground cabinet.

The trundler 408 carries the roller on wheels 407 along the sports field. The trundler has a motor 409, to rotate the roller. The motor is attached to a shaft 410 of the roller that runs along a centre of the roller. A power supply such as a battery for an electric motor or hydraulic power unit for a hydraulic motor may be carried on the trolley. One power supply may be provided on one trolley to power the motor at each end of the roller. As the roller moves across the field it rotates, to unwrap the cover from the roller onto the field. Rotation of the roller 401 may propel the roller along the field carried on the wheels of the trundler. Alternatively, the wheels 407 of the trundler may be driven. The rotational speed of the motor 409 or wheels 407 at each end of the roller may be controlled to give an operator the ability to steer the roller by either speeding one motor or trundler up or slowing one motor or trundler down.

Figure 16:
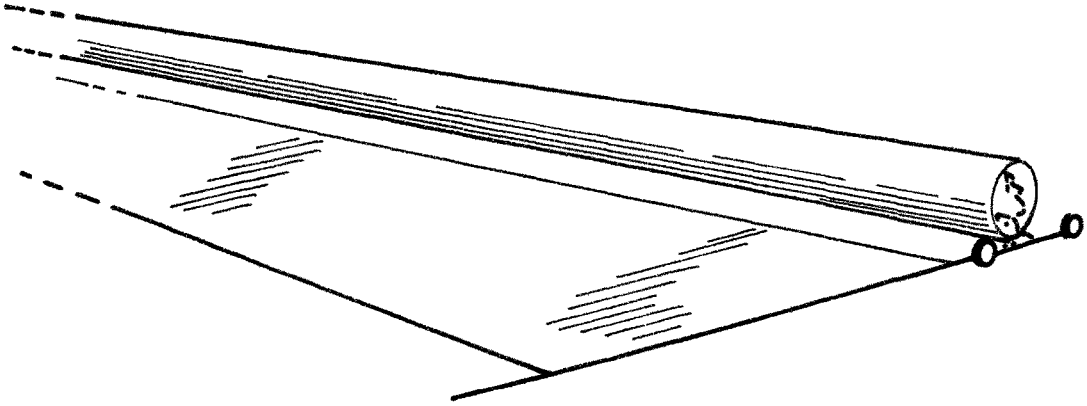
FIG. 16 is a side view of a deployed field cover.
Figure 17A:
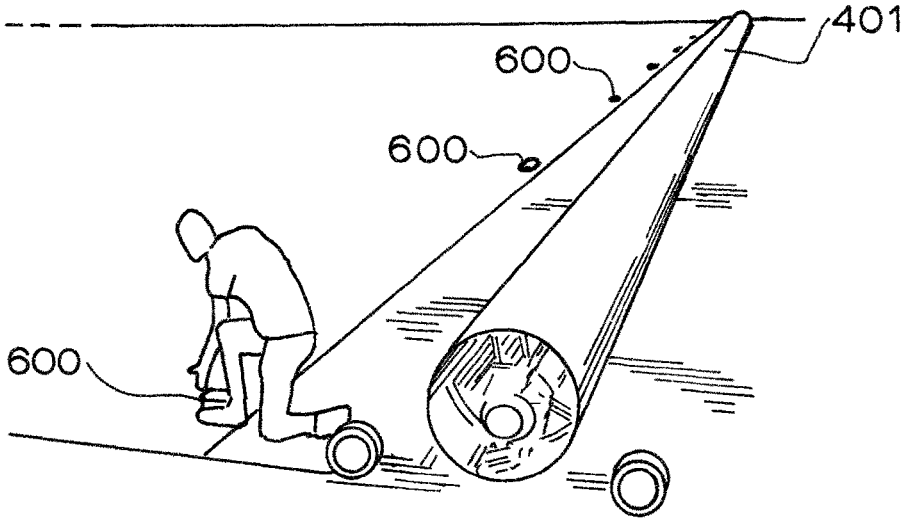
FIG. 17A shows an embodiment of the one or more fastening means.

As shown in FIGS. 16 and 17A and B, once the deployment of the field cover 201 onto the field is completed, the field cover 201 may be entirely detached from the roller 401. In some embodiments, the roller 401 may be stowed in the same or a different underground cabinet 400.

Figure 17B:
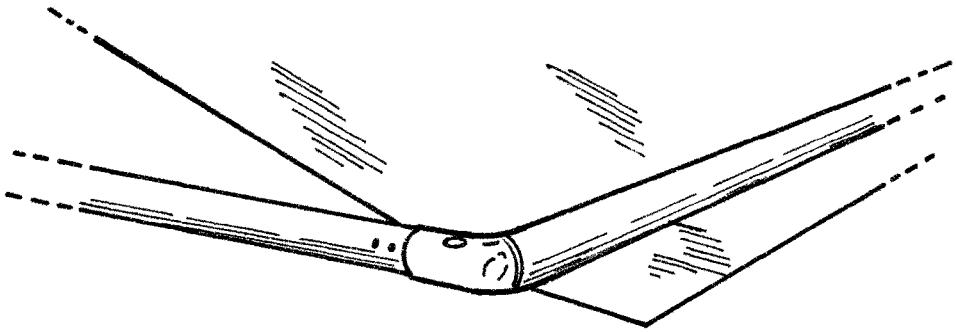
FIG. 17B shows perimeter framework of weighted poles to hold a perimeter of the cover down.

As mentioned above, in some embodiments the field cover 201 may comprise one or more anchoring corners 204 which may be fixed to the ground to secure the position of the field cover 201. In order to achieve a desired elevated or semi-elevated arrangement of the field cover 201 (such as shown in FIGS. 2-6), it may be necessary to secure the one or more anchoring corners 204 and/or edges of the field cover 201, prior to elevating the field cover 201 above the sports field surface, using fastening means 600 (as shown in FIG. 17A). In some embodiments, the anchoring corners 204 and/or edges can be secured to the ground using manually placed loads, such as sand bags and the like. In some embodiments, there may be provided mechanical fastening means 600 which may be used manually or automatically to secure the position of the anchoring corners 204 and/or edges of the field cover 201. In some embodiments, longitudinal members or a framework may be placed along edge portions of the cover to hold the cover down. As shown in FIG. 17B, a perimeter framework of weight poles may be placed around the perimeter of the cover. Weighted poles may be connected together at their ends via joints that form corners of the framework. Those skilled in the art will appreciate that other arrangements for fixing the field cover 201 to the ground are possible.

According to the present invention, after deployment of the field cover across the field, the plurality of support members 300 are be activated (manually or automatically) to extend from a retracted position to an extended position. The support members may be actuated substantially simultaneously or in a staged or sequential fashion. Possible embodiment(s) and functionalities of support members 300 and tensioned guy lines 301 are described in more detail below.

Reference is now made to FIGS. 18 to 24 which show embodiments of the support member 300. In some embodiments, the support member 300 may comprise at least one attachment eyelet/connection point 302 to which a guy line 301 can be attached. The attachment point may comprise a hook or post or other means to attach the guy line to the head or top of the elongate support means. Each guy line is attached between a pair of support members 300. In an unused first position (not shown), the support 300 is retracted and stored within a hole/cavity 500 in the ground and may be covered by a removable cap 502. In some embodiments, the surface of the removable cap 502 may be made up of astro-turf and the cap 502 may be configured to fit snugly within a rim 501 of the hole 500 while being flush with the grass surface. In some embodiments, the removable cap 502 may be rigid enough to support heavy objects, such as maintenance vehicles and the like. The cap may be attached to an end of the support member.

In some embodiments, as shown in FIGS. 20 to 24, each tensile member 301, 304 may be provided on a reel 303. The tensile member may be a cable such as a wire rope or a Dyneema® rope. The tensile member is unreeled from the reel to be deployed across the sports field. Each end of the tensile member is attached to an elongate support member on each side of the field. The tensile member is attached between a pair of elongate support members, each member locate on opposite sides of the field. In some embodiments, the tensile member 301, 304 and/or the reel 303 may be stored in an underground storage 306 comprising a cover or lid 307. In some embodiments, the cover 307 and lifting of the cable or rope 304 and/or reel 303 may be activated by a lever in an automatic and/or manual manner. One reel may be provided at one side of the sports field for each pair of elongate support members. For example, in the illustrated system of FIG. 2 comprising thee pairs of elongate support members, three reels may be provided, one for each pair. Each reel may be located in a cabinet below ground.

In some embodiments, a stay 304 may be provided to each elongate support member. The stay is attached at an anchor point at a low level or ground level. The stay counteracts a force provided to the support member by the tensile member 301. The stay may provide tension to the elongate support member or the tensile member 301 to further tension the cover. The stay may be pulled tight as the elongate support member moves from the retracted position to the extended position. The stays may be provided on a reel. The reel may be stored below ground in a cabinet, as described above. The stay may remain on the reel when attached to the elongate support member, with the reel providing tension to the stay. The reel may provide an anchor point for the stay. The reel may be driven to provide tension to the elongate support member.

In some embodiments, the tensile member 301 may form both the stay and the tensile member that extends between the elongate support members. For example, the tensile member may be deployed from a first anchor point at the ground level, through an eyelet of the elongate support member, across the sports field and through the eyelet of another elongate support member on an opposite side of the field, and secured to a second anchor point at the ground level on the opposite side of the field. As the elongate support members move to the extended position, the tensile member is tensioned between the first and second anchor points and between the elongate support members.

Figure 18:
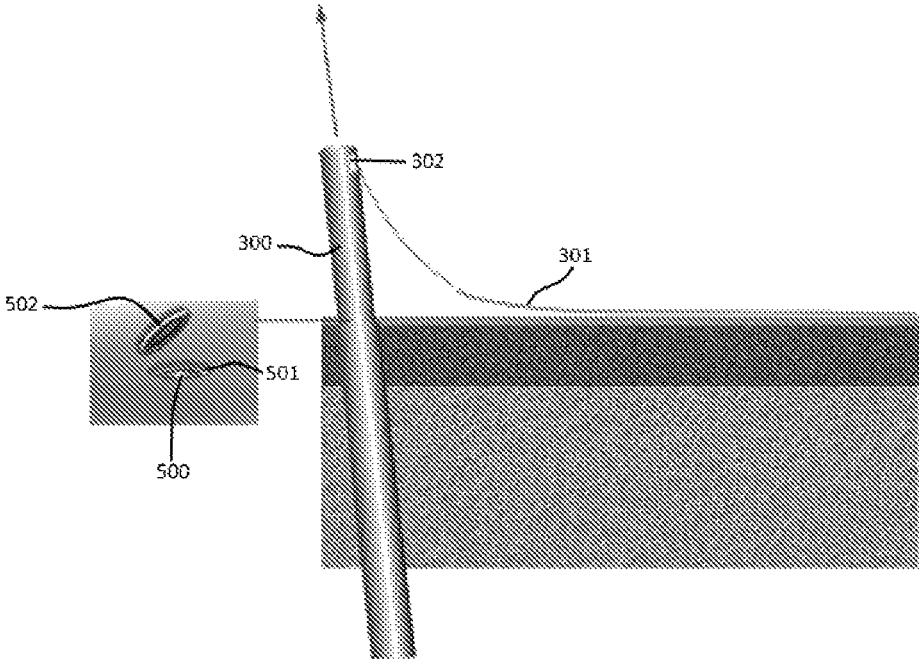
FIG. 18 is a vertical sectioned view of an embodiment of the angled support member in a partially extended position.
Figure 19:
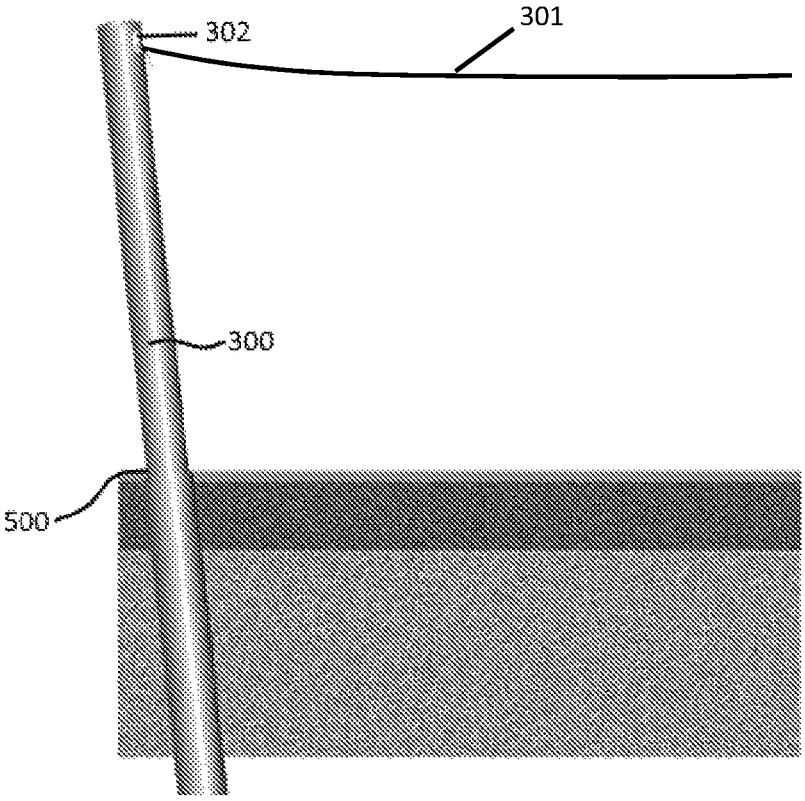
FIG. 19 is a vertically sectioned view of the angled support member of FIG. 18 in an extended position and connected to a tensile member as a guy line of the field cover.
Figure 20:
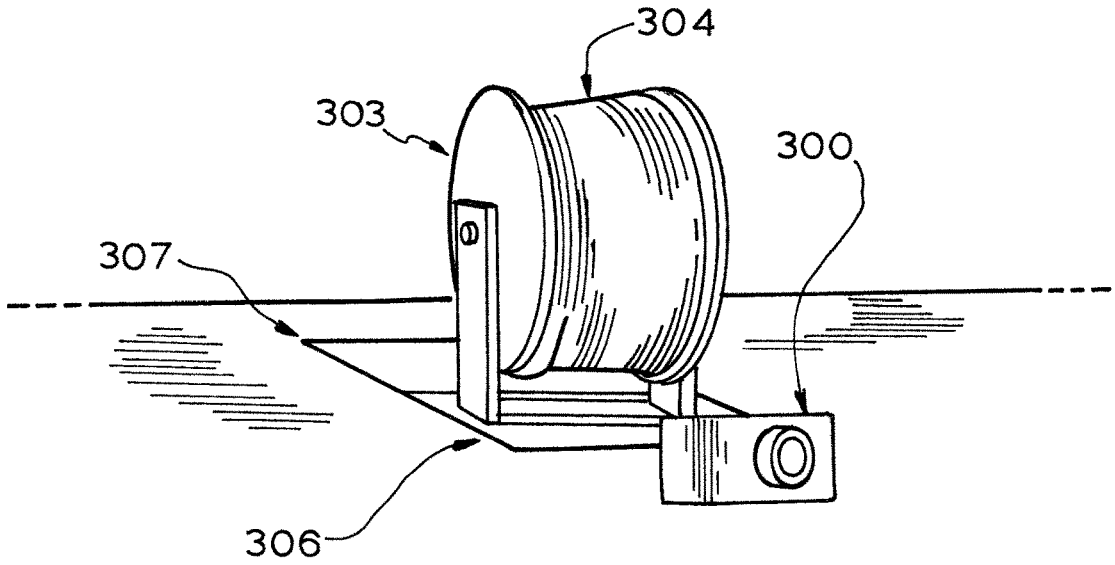
FIG. 20 shows an embodiment of the angled support member retracted, as well as a reel to further tension the tensile member, the reel here released from its stowage, constructed and operative in accordance with an embodiment of the present invention.
Figure 21:
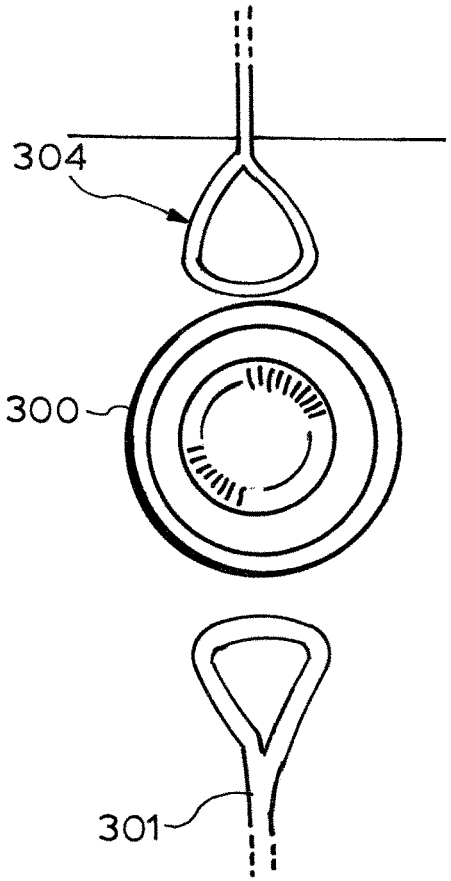
FIG. 21 is a top view of the angled support member of FIG. 20 in a first, non-functional arrangement with tensile members detached from its top connection.
Figure 22:
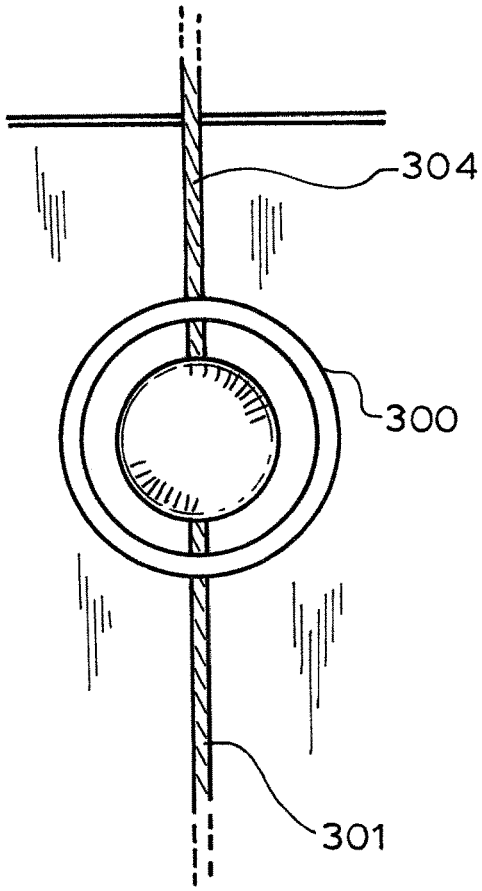
FIG. 22 is a top view of the angled support member of FIGS. 20-21 in a second, functional arrangement with the tensile members attached to a field cover and to a reel.
Figure 23:
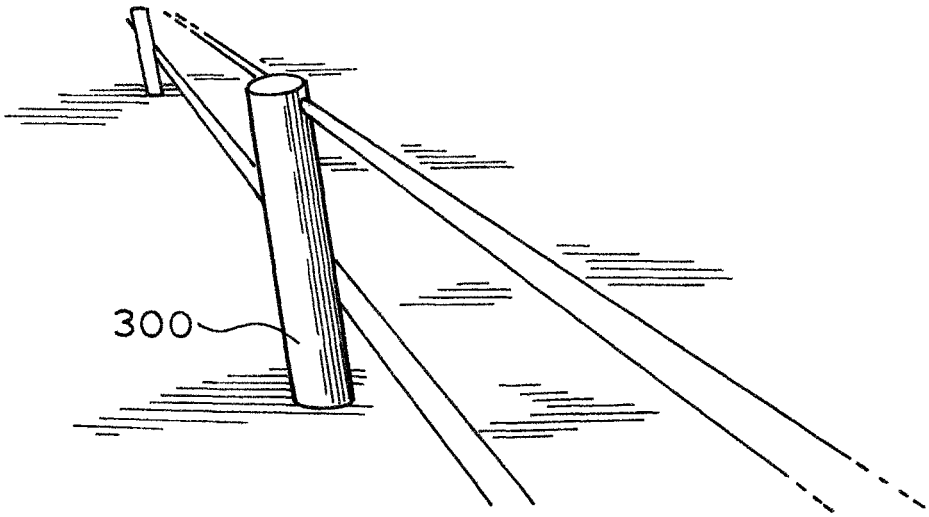
FIG. 23 shows the angled support member of FIGS. 20-22 in an extended position elevating the planar material as a cover.
Figure 24:
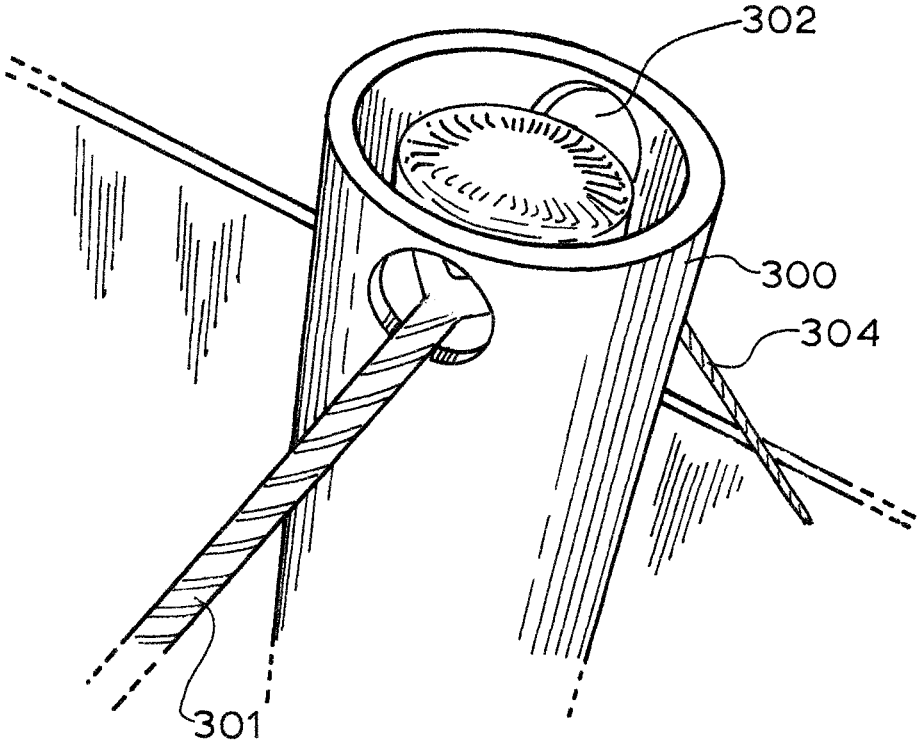
FIG. 24 shows the angled support member of FIGS. 20-23 in an extended position with a close up of the tensile members attached.

Once the field cover 201 has been deployed cross the field, the cover is lifted or elevated above the sports field to provide a required headspace 205 under the cover and to allow for air circulation below the cover. To raise or elevate the cover, the support member(s) 300 are raised or extended from the first or retracted position to a second or extended position, as indicated by the arrow in FIG. 18. In the extended position the support member may be angled outwards from the sports field, to help tension the tensile members 301 as the support members are moved to the extended position. As the support members 300 are angled outwards, the distance between the top of a pair of support members increases as they move to the extended position, to tension (ie straighten out) the tensile member extending between the pair of support members. The attachment eyelet 302 may only be visible and accessible when the angled support member 300 protrudes out of the hole 500. As a result, the support member 300 must protrude out of the hole/cavity 500 with the eyelet 302 being configured to receive and be attached to a guy line 301 and/or stay 304. In some embodiments, the support 300 may extend and protrude out of the hole 500 using a telescoping mechanism as shown in FIGS. 18 and 19. Other arrangements and mechanism for protruding the support member 300 out of the hole 500 are possible, such as a support member 300 that can be pivotally raised out of the hole 500 and into the illustrated desired angled position. In some embodiments, there may be provided a hydraulic, pneumatic, screw or similar extension system which provides the ability to remotely control and monitor (manually or automatically) the support member(s) 300. Other embodiments of the support member 300, such as a spring biased member, are possible.

Prior to moving the support members from the retracted position to the extended position, the ends of the tensile members 301 are attached to the support members. The tensile members 301 may be attached to the support members before or after the cover has been deployed from the roller across the field. With the tensile members 301 extending beneath the cover and/or attached to the cover and attached between pairs of support members, the support members are moved from the retracted position to the extended position to raise or elevate the cover above the sports field.

Figures 25A, 25B:
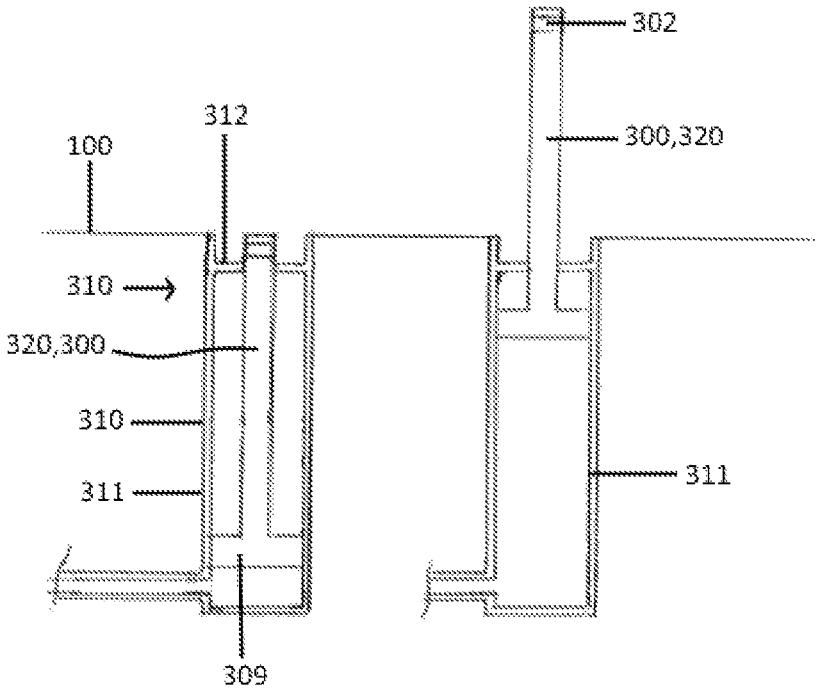
FIGS. 25A and 25B are schematic views of a hydraulic ram, wherein a piston rod of the ram provides an elongate support member.

With reference to FIGS. 25A and 25B, in some embodiments, each said support member 300 is a piston rod 320 of a hydraulic ram 310 (sometimes known as a hydraulic cylinder). The hydraulic ram 310 comprises a cylinder 311 and a piston 309 that strokes along the cylinder 310, and a piston rod 320 extending from the piston. The piston rod extends through a cylinder head 312 of the cylinder. The piston rod 320 forms the elongate support member 300. The cylinder is located below the surface of the sports field 100. The cylinder 311 may be located or installed in a cavity or hole formed in the sports field, with the head 312 of the cylinder at or slightly below the ground level. In this embodiment, the cylinder may be considered a chamber housing the piston rod support member 300 in the retracted position. A cap (e.g. 500 in FIG. 18) may be provided to cover the ram when in the retracted position, with the piston rod 300, 320 retracted into the cylinder 310, as shown in FIG. 25A. The piston and piston rod is driven by hydraulic pressure in the cylinder to move to the extended position with the piston rod extending from the cylinder above the ground, as shown in FIG. 25B. As described previously, a tensile member 301 is attached to an eyelet 302 or other detail such as a hook at the top of the piston rod when the piston rod is in the retracted position. The piston rod is then driven to the extended position, to raise the tensile member and cover 201 to an elevated position.

A benefit of a system with each said support member 300 being a piston rod of a hydraulic ram is that the hole or cavity in the ground has a depth equal to about the length of the ram in the retracted position. It is not necessary to have a deeper hole or cavity to house equipment below the ram.

The embodiment shown in FIGS. 25A and 25B may be suitable for smaller cover systems. For larger cover systems, providing a ram with the ram piston as the support member may not be economical.

Figures 26A, 26B:
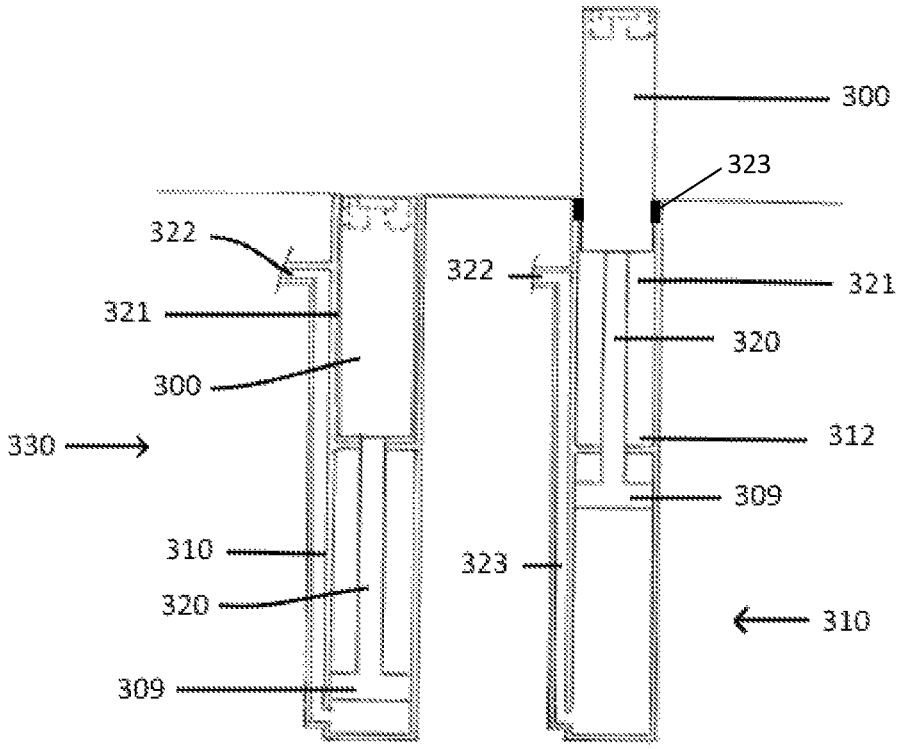
FIGS. 26A and 26B are schematic views of an elongate support member assembly.

With reference to FIGS. 26A and 26B, in some embodiments, each elongate support member 300 is a pole or post received in a chamber or housing 321 when in a retracted position. The elongate support member may be a tubular member, and may be a carbon fibre tube. A carbon fibre tube is stiff, providing sufficient stiffness to resist bending caused by the tensile member 301 attached to or adjacent to a top end of the elongate support member. The carbon fibre tube may have a diameter of about 280 mm.

The elongate support member 300 can slide within the chamber/housing to move between the retracted position as shown in FIG. 26A and an extended position as shown in FIG. 26B. The elongate support member telescopes into and out of the chamber. A driving means or actuator such as a hydraulic ram 310 is provided to a bottom end of the support member to drive the support member between the retracted and extended positions. The driving means may be attached to a bottom of the chamber. For example, in the illustrated embodiment, the driving means is a hydraulic ram attached to a bottom of the chamber and is outside of the chamber. A piston rod 320 of the ram 310 extends into the chamber 321, to drive the support member 300. A cylinder head 312 of the ram may be attached to a bottom of the chamber, or may form a bottom of the chamber.

A hydraulic power unit is provided (not shown) to provide hydraulic fluid to and from the cylinder to drive the piston between the retracted and extended positions, to raise and lower the cover. The hydraulic power unit may comprise a hydraulic fluid reservoir, pump, filter, and any other required known components such as valves and hydraulic lines, as known in the art. A single acting hydraulic ram is illustrated in FIGS. 25A to 26B, however, this is not intended to be limiting. The ram may be a double acting or a telescoping ram.

Other actuators are possible such as a rack and pinion, wherein the rack is provided to the elongate support member 300 and the pinion engages the rack. A motor such as an electric motor may be energised to drive rotation of the pinion to move the support member from or to the chamber. The pinon is preferably provided to an upper end of the housing or chamber 321, together with a motor to drive rotation of the pinon, such that power to the motor is not required to be provided to a bottom end of the chamber. A power connection or input to a motor for the pinion is preferably at or towards or adjacent a top end of the chamber or housing.

Preferably the elongate support member 300, chamber 321 and driving means 310 are provided together in a single unit 330 that is located or installed in a cavity or hole formed in the sports field, with a top end of the unit at or slightly below the ground level. The unit may be provided as an elongate support member assembly 330 having a movable elongate support member 300 to move between retracted and extended positions. The assembly is installed in the ground with an upper end of the assembly at or adjacent to the surface of the sports field.

Preferably a power connection or input 322 to provide power such as hydraulic and/or electrical power to the driving means is provided at or towards or adjacent a top end of the unit 330, as shown in FIGS. 26A and B, so that a deep trench is not required to provide services to the driving means 310. The unit may comprise one or more power lines 323 such as one or more electrical cables/wires or hydraulic galleries from the connection at the top or adjacent the top of the unit to the driving means at the bottom of the unit. Hydraulic galleries and/or electrical power lines may be provided in a wall of the chamber and/or cylinder.

Power, whether hydraulic or electrical, may be provided to the actuators 310 driving the elongate support members 300 in parallel, so that the elongate support members extend substantially simultaneously. Alternatively, one or more elongate members may be individually controlled between the retracted and extended positions.

A seal such as a wiper seal may be provided between the chamber/housing and the elongate support member, to prevent debris such as dirt entering the housing/chamber. The housing/chamber and/or the elongate support member may be provided with bearings, such as bearing rings, for the elongate support member to slide on in the housing/chamber.

In some embodiments, each of the support member(s) 300 may be protruded to a particular height in order to obtain a desirable arrangement of the semi-elevated field cover 201. In some embodiments, the support members 300 may be provided with a smart sensing system which provides the ability to automatically adjust the support members 300 in accordance to varying height and load parameters. For example, tension in the tensile members may be monitored, or alternatively bending of the elongate support members may be monitored (e.g. by strain gauges), and the height of the poles may be determined by the measured tension or bending. The poles 300 may be extended until a threshold tension in the tensile member(s) or bending of the poles is reached.

The embodiments described above eliminate the need for conventional bulky and inconvenient systems, such as winch tensioning systems. As a result, the system requires less maintenance and will be less prone to errors. Further, more room will be made available at the perimeter of the sports field 100, which, as understood by those skilled in the art, is a major advantage.

As explained above, in some embodiments, as shown in FIGS. 3-6, the semi-elevated field cover 201 may be convex (i.e. bulged) in length 202 (as shown in FIG. 3) and along a first axis, and concave (i.e. sagged) in width 203 (as shown in FIG. 4) and along a second axis, or may have a ridge. In some embodiments, the cover may slope from one side to the other, for example the system may comprise one or more support members 300 on one side of the sports field only, or the support members on one side of the field may be moved to the extended position while the support members on the opposite side of the field may remain in the retracted position, depending on a wind direction.

In some embodiments, there may be provided air conditioning and/or heating means that are configured to circulate and/or provide heat within the headspace 205 beneath the cover to maintain the quality of the sports field 100 by preventing build-up of moisture, sweat, frosts, dryness and the like.

Although the present invention has been described with reference to a semi-automated field cover system, it would be understood to a skilled person that the field cover is applicable to a range of applications where semi-automated field coverage and protection is an advantage. For instance, the system may be applied to any application where accurate, reliable and automated systems are advantageous. Increasing the accuracy and efficiency of the deployment of the field cover will avoid damage to the sports field that may have previously been experienced due to inaccurate, slow and inconvenient conventional deployments processes. The present invention provides a cover system that achieves a number of benefits, including but not limited to:

- efficient/fast deployment and retrieval of the cover, since the extending poles lift the cover automatically once pole movement initiated by grounds man;
- requires a low level of man power, for example may be deployed and retrieved by 2 to 3 people;
- deployment and retrieval is very fast compared to prior art systems. This means a cover can be deployed at any time. For example, the cover may be quickly deployed during a cricket match when rain stops play. Once the rain has passed, the cover may be quickly retrieved to allow play to continue. The cover may be deployed each night and retrieved each morning, to maintain grass temperatures and avoid frost. Deployment including raising the cover above the ground is expected to be completed in around 30 minutes for a football field and 15 minutes for a cricket pitch;
- having the poles/elongate support members below ground when not in use avoids health and safety issues relating to storage and moving/transporting heavy equipment;
- by raising the cover, water can run off the elevated cover to edge regions of the sports field, where drains are located;
- water does not lie on the surface of the cover, which makes retrieval of the cover far quicker compared to covers that lie flat on the ground;
- sweat and mold that can generate under covers lying flat on the ground is avoided;
- can be lifted to a height to allow marking, rolling and mowing and other ground maintenance to be carried out while the cover is deployed;
- angled supports tensions cover or guy lines as the poles extend.

From the foregoing it will be seen that a semi-automated field cover system is provided which enhances both the quality and efficiency requirements to be met.

Unless the context clearly requires otherwise, throughout the description, the words "comprise", "comprising", and the like, are to be construed in an inclusive sense as opposed to an exclusive or exhaustive sense, that is to say, in the sense of "including, but not limited to".

Although this invention has been described by way of example and with reference to possible embodiments thereof, it is to be understood that modifications or improvements may be made thereto without departing from the scope of the invention. The invention may also be said broadly to consist in the parts, elements and features referred to or indicated in the specification of the application, individually or collectively, in any or all combinations of two or more of said parts, elements or features. Furthermore, where reference has been made to specific components or integers of the invention having known equivalents, then such equivalents are herein incorporated as if individually set forth.

We claim:

1. A field cover system to selectively cover, and uncover, a sports field having a periphery, the field cover system comprising:

a field cover comprising a flexible resilient planar material to extend from a roll and cover the sports field, and to retract to the roll and uncover the sports field;

a plurality of pairs of elongate support members at or near the periphery of the sports field, moveable to extend between a retracted position and an extended position, in the extended position the plurality of pairs of elongate support members extending above the sports field, with the proviso that no elongate support members are inside the periphery of the sports field in the extended position; and one or more tensile members configured to, in use, support and/or attach to the field cover and attach to the plurality of pairs of elongate support members, and wherein in the retracted position the plurality of pairs of elongate support members is located substantially below a surface level of the sports field, and in the extended position and with the tensile members attached to or supporting the field cover, the elongate support members elevate the flexible resilient planar material above the sports field;

wherein the plurality of pairs of elongate support members is angled outwards with respect to a centerline of the sports field so that a said tensile member and/or the field cover attached between a pair of said elongate support members is tensioned as the pair of elongate support members move from the retracted position to the extended position to support the field cover above the sports field, wherein the plurality of pairs of elongate support members is arranged in pairs, the elongate support members of each pair arranged on opposite sides of the sports field, and wherein the sports field is selected from a tennis court, a cricket pitch, a lawn bowls field, a baseball field, a softball field, a soccer field, a rugby field, a rugby league field, an American football field, an Australian rules football field, field hockey fields, netball courts, and a golf course.

2. The system as claimed in claim 1, wherein the system comprises a plurality of hydraulic rams, each ram comprising a piston, a piston rod extending from the piston, and a cylinder, and wherein each elongate support member is a said piston rod, and wherein each cylinder is located substantially below the surface level of the sports field with a cylinder head at or adjacent the surface level of the sports field.

3. The system as claimed in claim 1, wherein the system comprises a plurality of chambers located substantially below the surface level of the sports field, the plurality of pairs of elongate support members received in the plurality of chambers when in the retracted position, and the elongate support members extending from the chambers to above the surface level of the sports field in the extended position.

4. The system as claimed in claim 1, wherein the system comprises a plurality of actuators to drive the elongate support member between the retracted and extended positions.

5. The system as claimed in claim 1, wherein the system comprises a plurality of elongate support member assemblies, each assembly comprising a chamber or housing located substantially below the surface level of the sports field, a said elongate support member slidingly received in the chamber or housing, and an actuator to move the elongate support member between the retracted position received in the chamber or housing substantially below ground level and the extended position to extend from the chamber or housing to above the surface level of the sports field.

6. The system as claimed in claim 5, wherein the elongate support member telescopes into the chamber or housing to move from the extended position to the retracted position.

7. The system as claimed in claim 5, wherein each elongate support member assembly comprises a seal between the chamber or housing and the elongate support member to avoid or minimize debris passing into the chamber or housing.

8. The system as claimed in claim 5, wherein the actuator is a ram.

9. The system as claimed in claim 8, wherein the ram comprises a piston and a cylinder and wherein the piston is provided to a bottom end of the elongate support member.

10. The system as claimed in claim 8, wherein the ram is a hydraulic ram.

11. The system as claimed in claim 10, wherein the ram is attached to a bottom of the chamber or wherein a cylinder head of the ram is attached to the bottom of the chamber or forms the bottom of the chamber.

12. The system as claimed in claim 5, wherein each elongate support member assembly comprises a power connection or input at or towards or adjacent a top end of the chamber or housing.

13. The system as claimed in claim 1, wherein the system comprises a plurality of caps to cover the plurality of pairs of elongate support members when in the retracted position with the plurality of covers caps substantially flush with the surface of the sports field.

14. The system as claimed in claim 1, wherein the plurality of pairs of elongate support members is angled outwards with respect to a centerline of the sports field at an angle ranging from 10 degrees to 45 degrees.

15. The system as claimed in claim 1, wherein the plurality of pairs of elongate support members is arranged in at least three pairs, the elongate support members of each pair arranged on opposite sides of the sports field.

16. The system as claimed in claim 15, wherein, in the extended position, a central pair of elongate support members extend higher than other pairs of elongate support members.

17. The system as claimed in claim 16, wherein the central pair of elongate support members is longer than one or more other pairs of elongate support members.

18. A method for covering a sports field with a field cover system of claim 1, comprising:

deploying the field cover material from the roll over the sports field, anchoring the field cover to the sports field at least in two or more opposing comers or ends of the field cover, connecting the one or more tensile members to the plurality of pairs of elongate support members at or towards a periphery of the field cover or sports field, while the elongate support members in a retracted position substantially below a surface level of the sports field, extending the plurality of pairs of elongate support members upwardly from the retracted position substantially below the level of the sports field to an extended position above the sports field, to tension the tensile members and/or the cover material and lift the cover material above the sports field, and wherein the sports field is selected from a tennis court, a cricket pitch, a lawn bowls field, a baseball field, a softball field, a soccer field, a rugby field, a rugby league field, an American football field, an Australian rules football field, field hockey fields, netball courts, and a golf course.

19. The method as claimed in claim 18, wherein the method comprises:

laying the one or more tensile members across the field and attaching each tensile member between a pair of said elongate support members, deploying the field cover from the roll over the sports field and over the tensile members, with the plurality of pairs of elongate support members in the retracted position substantially below a surface level of the sports field.

20. The method as claimed in claim 18, wherein the method comprises: attaching the field cover to the plurality of pairs of elongate support members with the elongate support members in the retracted position substantially below a surface level of the sports field.

21. The method as claimed in claim 18, wherein the method comprises:

providing the plurality of pairs of elongate support members angled outwards with respect to a centerline of the supports field, and extending the plurality of elongate support members so that said tensile members and/or the cover are/is tensioned as the elongate support members move from the retracted position to the extended position.

22. The method as claimed in claim 18, wherein the method comprises:

extending a central pair of elongate support members higher than other pairs of elongate support members.

* * * * *